US005431223A

United States Patent [19]

Konopczynski

[11] Patent Number: 5,431,223

[45] Date of Patent: Jul. 11, 1995

[54] DRILLING KICK-OFF DEVICE

[75] Inventor: Michael R. Konopczynski, Calgary, Canada

[73] Assignee: Shell Oil Company, Houston, Tex.

[21] Appl. No.: 234,220

[22] Filed: Apr. 28, 1994

[30] Foreign Application Priority Data

Apr. 30, 1993 [CA] Canada ..... 2095306

[51] Int. Cl.[6] ..... E21B 7/08

[52] U.S. Cl. ..... 166/117.5; 175/78; 175/79

[58] Field of Search ..... 166/177.5, 117.6; 175/78, 79, 80, 81, 82, 61

[56] References Cited

U.S. PATENT DOCUMENTS

| | | | |
|---|---|---|---|
| 2,693,342 | 11/1954 | Lynes | 175/78 |
| 4,396,075 | 8/1983 | Wood et al. | 175/79 |
| 4,573,541 | 3/1986 | Josse et al. | 175/78 |

OTHER PUBLICATIONS

"Engineering, Drilling and Production Operations," *The Petroleum Handbook*, 6th Edition, Elsevier, pp. 134–137 (1983).

*Primary Examiner*—Stephen J. Novosad

[57] ABSTRACT

A kick-off device is provided. The kick-off device is useful in drilling a pair of opposite deviated borehole branches in an under ground formation from a single borehole and comprises an open-ended tube provided at its upper end with connecting means to join the open-ended tube to a string of casing, and a guide element arranged in the open-ended tube near its lower end, which guide element includes two hollow slanted guide ways arranged on opposite sides of the guide element, wherein the wall of the open-ended tube has elongated openings facing the slanted guide ways.

2 Claims, 3 Drawing Sheets

DRILLING KICK-OFF DEVICE

FIELD OF THE INVENTION

The present invention relates to drilling deviated borehole branches in an underground formation from a single borehole.

BACKGROUND TO THE INVENTION

The single borehole from which deviated boreholes are drilled in the present invention is in general a vertical borehole. In order to reach widely spread targets one or more deviated borehole branches are drilled from the single borehole. A kick-off device is often used to initiate drilling of a deviated borehole from the single borehole. The kick-off device may be, for example, a device in the form of a steel wedge or whipstock arranged at the point in the single well where the deviated wellbores are to be initiated. On continuing drilling, the drill bit follows the wedge and a deviated borehole branch is drilled. A description of this method may be found in The Petroleum Handbook, 6th Edition, Elsevier, 1983, pages 135–136.

When it is required to drill two of opposite borehole branches the second borehole branch can be drilled using a whipstock oriented in a direction opposite to the direction of the first borehole branch.

A kick-off device used to drill more than one deviated borehole branch is disclosed in U.S. Pat. No. 4,573,541. This device comprises a tubular housing and three guide tubes arranged in the housing. Two of the guides are curved away from the central longitudinal axis of the housing. The deviated borehole branch is drilled by arranging the device in the lower end of the cased single borehole, guiding the drill bit into one of the two curved guide tubes and drilling.

The kick-off device of U.S. Pat. No. 4,573,541 requires that the diameter of the guide tubes be smaller than half the diameter of housing. The curved borehole branches must therefore have a diameter that is much smaller than the diameter of the original borehole from which they are drilled.

It is therefore an object of the present invention to provide a kick-off device that allows drilling a pair of deviated borehole branches from a central wellbore, extending in opposite directions from the central wellbore, wherein the maximum diameter of the branched borehole section is limited by the diameter of the drill bit that can pass through the cased single borehole. It is a further object to provide such a method wherein the pair of deviated borehole branches may extend from about the same point in the central wellbore.

SUMMARY OF THE INVENTION

These and other objects are accomplished by a kick-off device to aid drilling a pair of opposite deviated borehole branches in an underground formation from a single borehole comprising an open-ended tube provided at its upper end with connecting means to join the open-ended tube to a string of casing, and a guide element arranged in the open-ended tube near its lower end, which guide element includes two slanted guide ways arranged on opposite sides of the guide element.

The slanted guide ways are preferably hollow.

To avoid drilling through a metal wall, the wall of the open-ended tube preferably defines an elongated openings facing the slanted guide ways.

The open-ended tube may also be provided at its lower end with connecting means to join one or more additional joints of casing to the lower end of the open-ended tube in order to centralize the open-ended tube in the single borehole.

The invention also relates to a re-entry device that can be removably placed in the kick-off device of the present invention. The re-entry device comprises an open-ended liner having an elongated opening in its wall, a slanted deflecting surface arranged in the open-ended liner facing the elongated opening. The re-entry device can be so placed in the kick-off device that the slanted deflecting surface meets one of the two slanted guide ways.

The re-entry device may further comprise a meeting element arranged in the lower end part of the open-ended liner, which meeting element has a sole to allow the meeting element to rest on the guide element and includes a wedge-shaped part to allow placing the meeting element in a predetermined position with respect to one of the slanted guide ways.

BRIEF DESCRIPTION OF THE FIGURES

FIG. 3 shows a longitudinal view along line III—III of

DETAILED DESCRIPTION OF THE INVENTION

Figure 1:
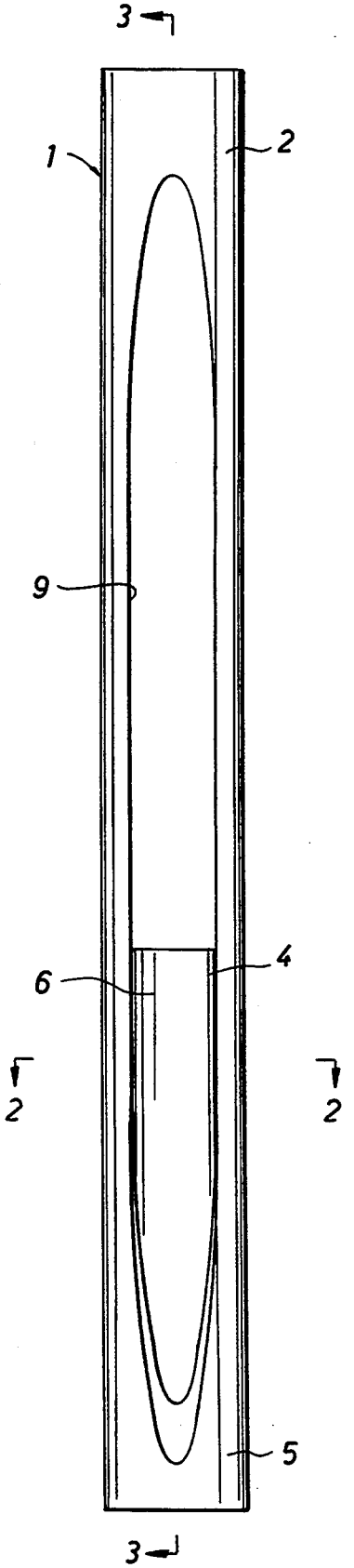
FIG. 1 shows schematically a side view of the kick-off device according to the present invention.
Figure 2:
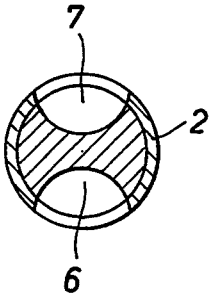
FIG. 2 shows a cross-sectional view along line II—II of FIG. 1.
Figure 3:
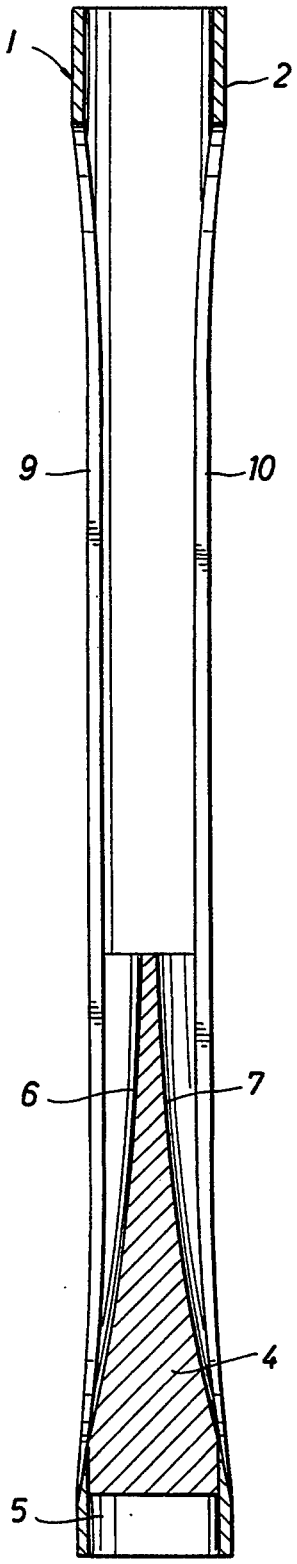

Reference is now made to FIGS. 1 through 3. The kick-off device 1 of the present invention comprises an open-ended tube 2 provided at its upper end with connecting means (not shown) to join the open-ended tube to a string of casing, and a guide element 4 arranged in the open-ended tube near its lower end 5.

The guide element 4 includes two slanted guide ways 6 and 7 arranged on opposite sides of the guide element 4. In the embodiment shown the guide ways 6 and 7 are hollow.

The wall of the open-ended tube 2 has elongated openings 9 and 10 facing the slanted guide ways 6 and 7.

Figure 4:
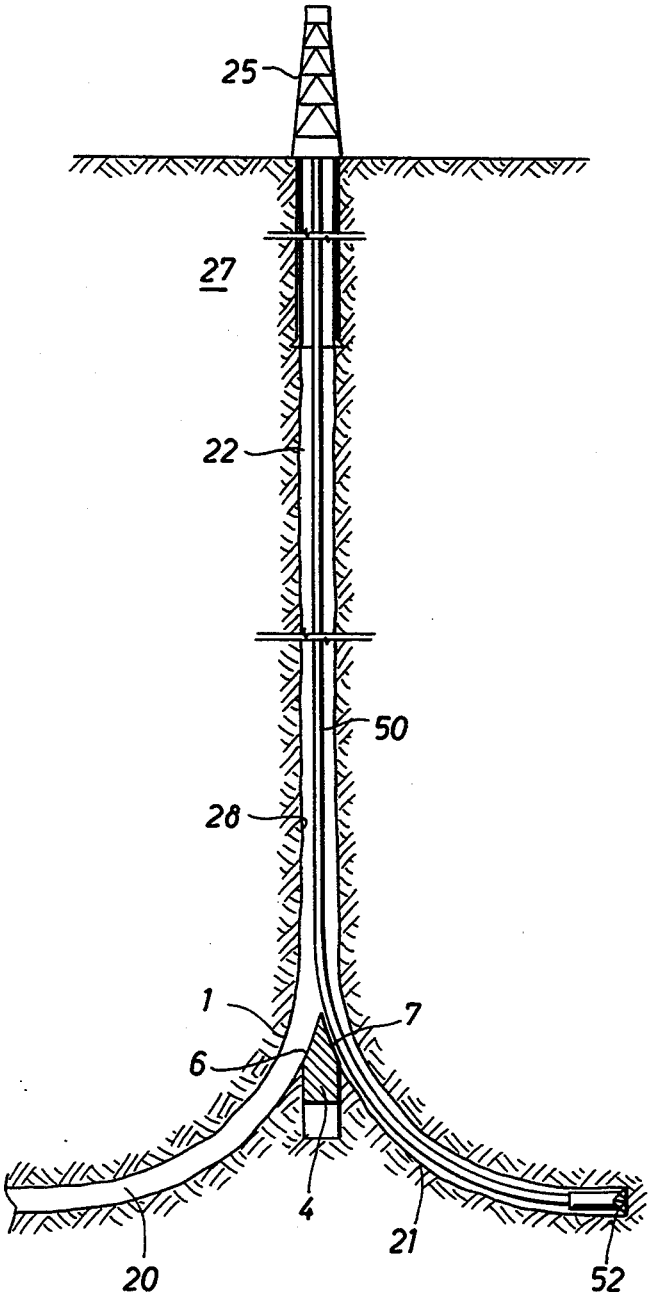
FIG. 4 shows schematically and not to scale a pair of opposite deviated borehole branches drilled from a single borehole.
Figure 5:
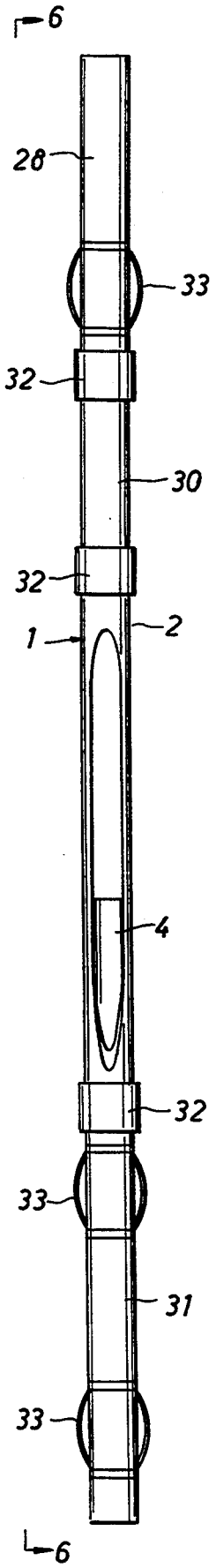
FIG. 5 shows schematically a side view of a casing string provided with the kick-off device of the present invention.
Figure 6:
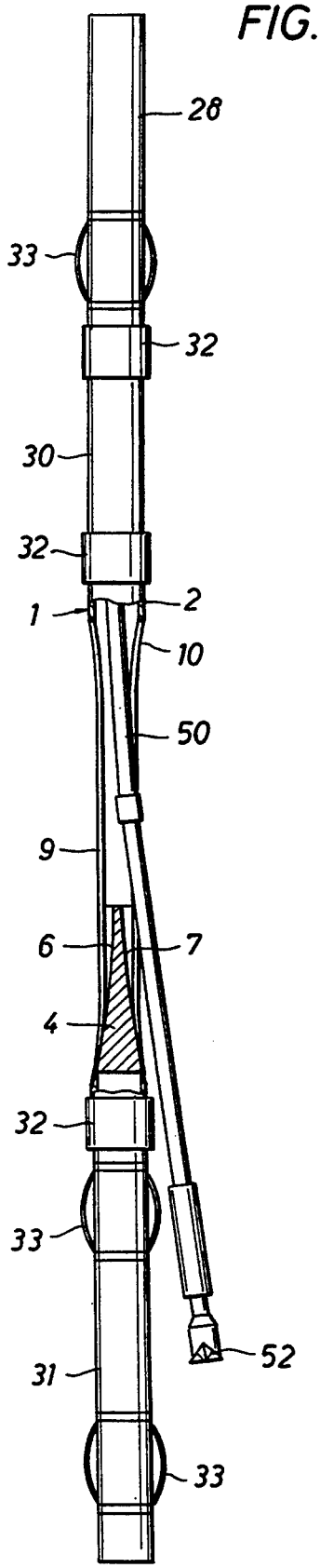
FIG. 6 shows a partial cross-sectional view along line VI—VI of FIG. 5.

Reference is now made to FIGS. 4 through 6. FIG. 4 shows schematically and not to scale the drilling of a pair of opposite deviated borehole branches 20 and 21 from a single central borehole 22 drilled from a drilling rig 25 in an underground formation 27. The single borehole 22 has been cased with a casing string 28 near its lower end with the kick-off device 1. The casing string 28 is cemented in the single borehole 22 in a conventional way, as is well known in the art.

The lower end of the casing string 28 is shown in more detail in FIGS. 5 and 6. The kick-off device 1 is arranged between the last section 30 of the casing string and a tail section 31, to this end the open-ended tube 2 is provided at both ends with connecting means. The tail section 31 comprises a joint of casing and it serves to centralize the kick-off device 1 in the single borehole 22. The connections between the sections are referred to by reference numerals 32. The casing string 28 is furthermore provided with centralizers 33 to centralize the casing string 28 in the single borehole 22 (see FIG. 4).

To drill a deviated borehole branch a drill string assembly 50 (see FIG. 6) having a drill bit 52 at its lower end is lowered into the casing string 28. The guide element 4 deflects the drill bit 52 and on rotating the drill bit 52 drilling a deviated borehole branch is started. The hollow form of the guide ways 6 and 7 facilitates control of the direction of the drill bit 52 and the drill string assembly 50 as drilling continues.

This is also shown in FIG. 4, wherein the drill bit 52 is shown in the deviated borehole branch 21. In FIG. 4 it has been assumed that branch 20 has already been drilled.

Figure 7:
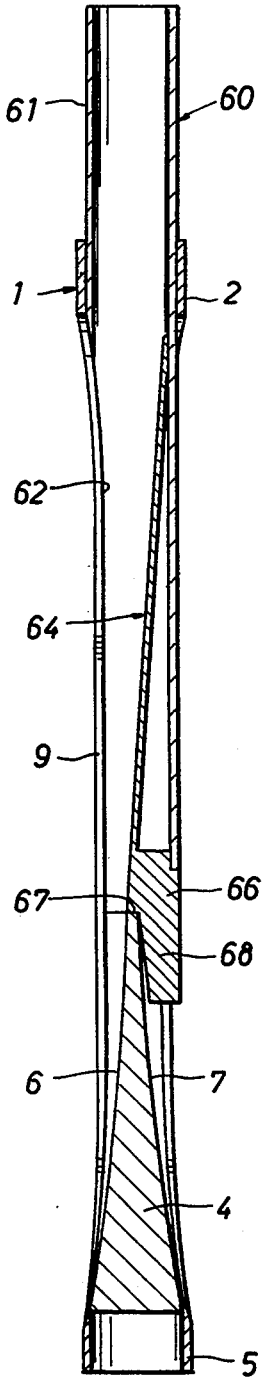
FIG. 7 shows schematically the kick-off device provided with a re-entry device according to the invention.

To facilitate entering in one of the deviated borehole branches, a re-entry device can be lowered into the kick-off device of the invention, the outer diameter of the re-entry device being smaller than the inner diameter of the kick-off device. The reentry device arranged in the kick-off device is shown in FIG. 7. The re-entry device is referred to by reference numeral 60 and it has been removably placed in the kick-off device 1. The re-entry device 60 comprises an open ended liner 61 having an elongated opening 62 in its wall, a slanted deflecting surface 64 arranged in the open ended liner 61 facing the elongated opening 62. The reentry device 60 has been so placed in the kick-off device 1 that the slanted deflecting surface 64 meets the slanted guide way 6 which is one of the two slanted guide ways 6 and 7.

To orient the re-entry device 60, it further comprises a meeting element 66 arranged in the lower end part of the open ended liner 61, which meeting element 66 has a sole 67 to allow the meeting element 66 to rest on the guide element 4. The re-entry device 60 also includes a wedge shaped part 68 to allow placing the meeting element 66 in a predetermined position with respect to one of the slanted guide ways 6 or 7.

The re-entry device 60 is lowered into the casing string 28, for example at the end of a drill string (not shown) to which it is removably connected. After having placed the re-entry device 60 the drill string is removed from the re-entry device and pulled out of the borehole.

When a tool has to be lowered into borehole branch 20 (see FIG. 4), the re-entry device 60 is placed in the kick-off device 1 as shown in FIG. 7. The tool (not shown) is then lowered through the casing section and is guided along the slanted deflecting surface 64 into the borehole branch.

To secure the re-entry device 60 in the kick-off device 1, the re-entry device 60 may include a releasable lock assembly (not shown).

The re-entry device 60 can also be used to drill one of the deviated borehole branches. To this end drilling the deviated borehole branch is started as described with reference to FIGS. 4–6. When about 1 m has been drilled, the drill string assembly is removed from the borehole, the re-entry device is attached to the kick-off device and drilling the deviated borehole branch is resumed.

I claim:

1. A re-entry device which can be removably placed in a kick-off device having two slanted guide ways, the re-entry device comprising:

an open-ended liner having an elongated opening in a wall of the liner;

a slanted deflecting surface arranged in the open-ended liner facing the elongated opening, wherein when the re-entry device can be so placed in the kick-off device that the slanted deflecting surface meets one of two slanted guide ways of the kick-off device.

2. The re-entry device of claim 1 further comprising a meeting element arranged in the lower end part of the open-ended liner, which meeting element has a sole to allow the meeting element to rest on the guide element and includes a wedge-shaped part to allow placing the meeting element in a predetermined position with respect to one of the slanted guide ways.

* * * * *